US007356271B2

(12) United States Patent
Nishi

(10) Patent No.: US 7,356,271 B2
(45) Date of Patent: Apr. 8, 2008

(54) ENERGY CONSERVING FUSER AND METHOD FOR IMAGE FORMING

(75) Inventor: Takayuki Nishi, Fujisawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/610,277

(22) Filed: Dec. 13, 2006

(65) Prior Publication Data

US 2007/0086798 A1 Apr. 19, 2007

Related U.S. Application Data

(63) Continuation of application No. 10/782,281, filed on Feb. 19, 2004, now Pat. No. 7,209,674.

(60) Provisional application No. 60/492,869, filed on Aug. 6, 2003.

(51) Int. Cl.
*G03G 15/20* (2006.01)

(52) U.S. Cl. ..... 399/45; 399/69

(58) Field of Classification Search ..... 399/33, 399/45, 67, 69, 88, 334
See application file for complete search history.

(56) References Cited

U.S. PATENT DOCUMENTS

| | | | | |
|---|---|---|---|---|
| 4,338,503 A | | 7/1982 | Ito | |
| 4,614,565 A | | 9/1986 | Riihinen | |
| 5,966,562 A | * | 10/1999 | Maehara | 399/69 |
| 6,122,476 A | * | 9/2000 | Bowler, Jr. | 399/328 |
| 6,411,785 B1 | * | 6/2002 | Ogawahara et al. | 399/69 |
| 6,492,630 B2 | | 12/2002 | Nagahira | |
| 6,763,206 B2 | | 7/2004 | Kinouchi | |
| 6,816,698 B2 | | 11/2004 | Morihara | |
| 6,898,410 B2 | * | 5/2005 | Boss | 399/330 |
| 6,989,516 B1 | | 1/2006 | Domoto | |

FOREIGN PATENT DOCUMENTS

| | | |
|---|---|---|
| JP | HO 5-27642 | 2/1993 |
| JP | 08110731 A | 4/1996 |
| JP | 2002 167081 A | 6/2002 |

* cited by examiner

*Primary Examiner*—David M. Gray
*Assistant Examiner*—Ryan Gleitz
(74) *Attorney, Agent, or Firm*—SoCal IP Law Group LLP; Steven C. Sereboff; John E. Gunther

(57) ABSTRACT

Apparatus and methods for fusing developer are disclosed. A developer fuser may include a first heating element for transferring energy for fusing developer to a media. The developer fuser may have a controller for controlling the power applied to the first heating element. Upon initiation of a copy process, the power applied to the first heating element may be set to a set-up power level determined, at least in part, by a physical characteristic of the media. The power applied to the first heating element may be further varied in response to a first temperature sensor to maintain a fixing temperature during the copy process. The fixing temperature may be determined, at least in part, by the physical characteristic of the media.

18 Claims, 8 Drawing Sheets

ENERGY CONSERVING FUSER AND METHOD FOR IMAGE FORMING

RELATED APPLICATION INFORMATION

This application is a continuation of U.S. application Ser. No. 10/782,281 filed Feb. 19, 2004, now U.S. Pat. No. 7,209,674, which, in turn, claims priority from U.S. Provisional Application No. 60/492,869 filed Aug. 6, 2003.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

BACKGROUND OF THE INVENTION

1. Field of the Invention

This invention relates to a fixing device of an image forming apparatus such as a copier or a printer.

2. Description of Related Art

An image forming apparatus using digital technology may include a fixing device which fixes developer by applying pressure to images heat fused on a media such as paper.

In an electronic copier, the catoptric light from an original is photo electrically converted by the photoelectric conversion element, such as a CCD (charge coupled device), and an electrostatic latent image corresponding to an acquired image signal is formed on a photo conductor. The electrostatic latent image is generated by adhering a developer (toner) selectively. A developer image on the photo conductor is transferred to medias supplied at the predetermined timing, and fixed with the fixing device.

Fixing devices are equipped with a heating member which fuses a developer, such as a toner, and a pressurizing member which provides this heating member with a predetermined pressure. The developer images on a media are melted between the heating and pressurizing members with heat from the heating member, and fixed on the media by pressure from the pressurizing member.

Induction-heating is one method of heating a fixing device. The induction-heating method uses a coil. By applying high frequency current to the coil, a predetermined magnetic field is generated, and the joule heat caused by the eddy current generated from the magnetic field heats the heating member.

DESCRIPTION OF THE DRAWINGS

FIG. 5(*b*) is a circuit diagram of the heating unit of FIG. 5(*a*).

FIG. 6(*b*) is a circuit diagram of the heating unit of FIG. 6(*a*).

FIG. 6(*c*) is a circuit diagram of the heating unit of FIG. 6(*a*).

DETAILED DESCRIPTION OF THE INVENTION

Throughout this description, the embodiments and examples shown should be considered as exemplars, rather than limitations on the apparatus and methods of the present invention.

Figure 1:
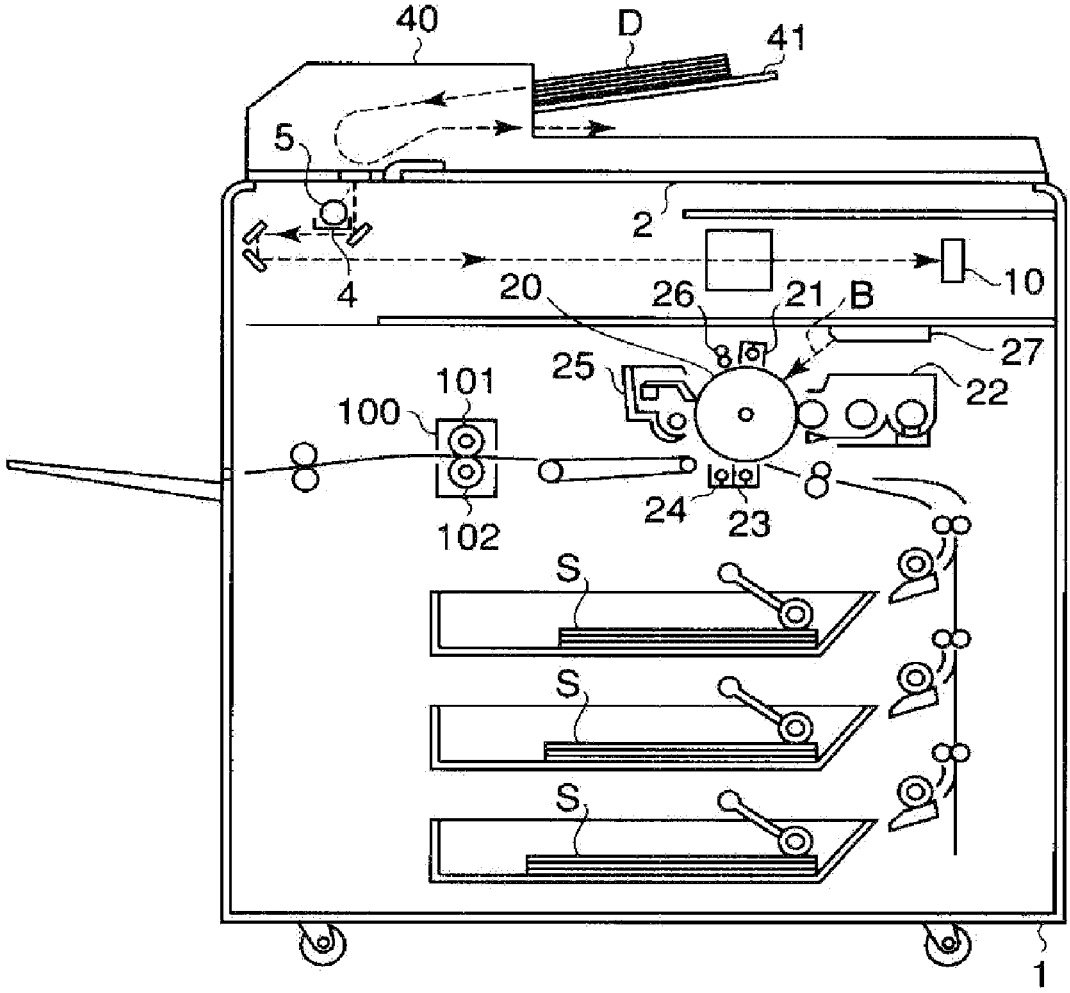
FIG. 1 is a perspective view of a compound-type electronic copier including a fixing device of this invention.

Referring now to FIG. 1, there is shown a compound-type electronic copier 1, an embodiment of an image forming apparatus. An original stand (glass plate) 2, to which an original D may be set, may be prepared at the upper surface of the compound-type electronic copier 1. The original D put on the original stand 2 may be illuminated by an illumination light from an exposure lamp 5 of a carriage 4 prepared with the original stand 2.

A catoptric light from the original D may be photo electrically converted by a CCD (charge coupled device) 10, which is a photoelectric conversion element. Thereby, an image signal corresponding to an image information on the original D is obtained. The image signal outputted from the CCD 10 may be converted into a digital signal in an image-processing portion, and may be supplied to a laser unit 27 after a predetermined image processing is performed.

A laser beam B may illuminate a photoconductive drum 20 by the laser unit 27 according to an output signal to which an image processing was performed in the image-processing portion. The photoconductive drum 20 may be prepared in a predetermined position in the copier 1 so that a latent image can be held by being irradiated by light while charging. A charger 21, a developing unit 22, a transfer unit 23, a separator 24, a cleaner 25, and a discharger 26 may be disposed in the circumference of the photoconductive drum 20 sequentially. Although it is not explained in detail, the latent images may be formed in the photoconductive drum 20 by the laser beam B from the laser unit 27. The latent images formed on the photoconductive drum 20 may be developed with a toner, selectively supplied from the developing unit, and may be transferred to a media supplied at a predetermined timing. The media may be a paper, a transparency, a metal film, canvas, plastic, hybrid or other.

Figure 2:
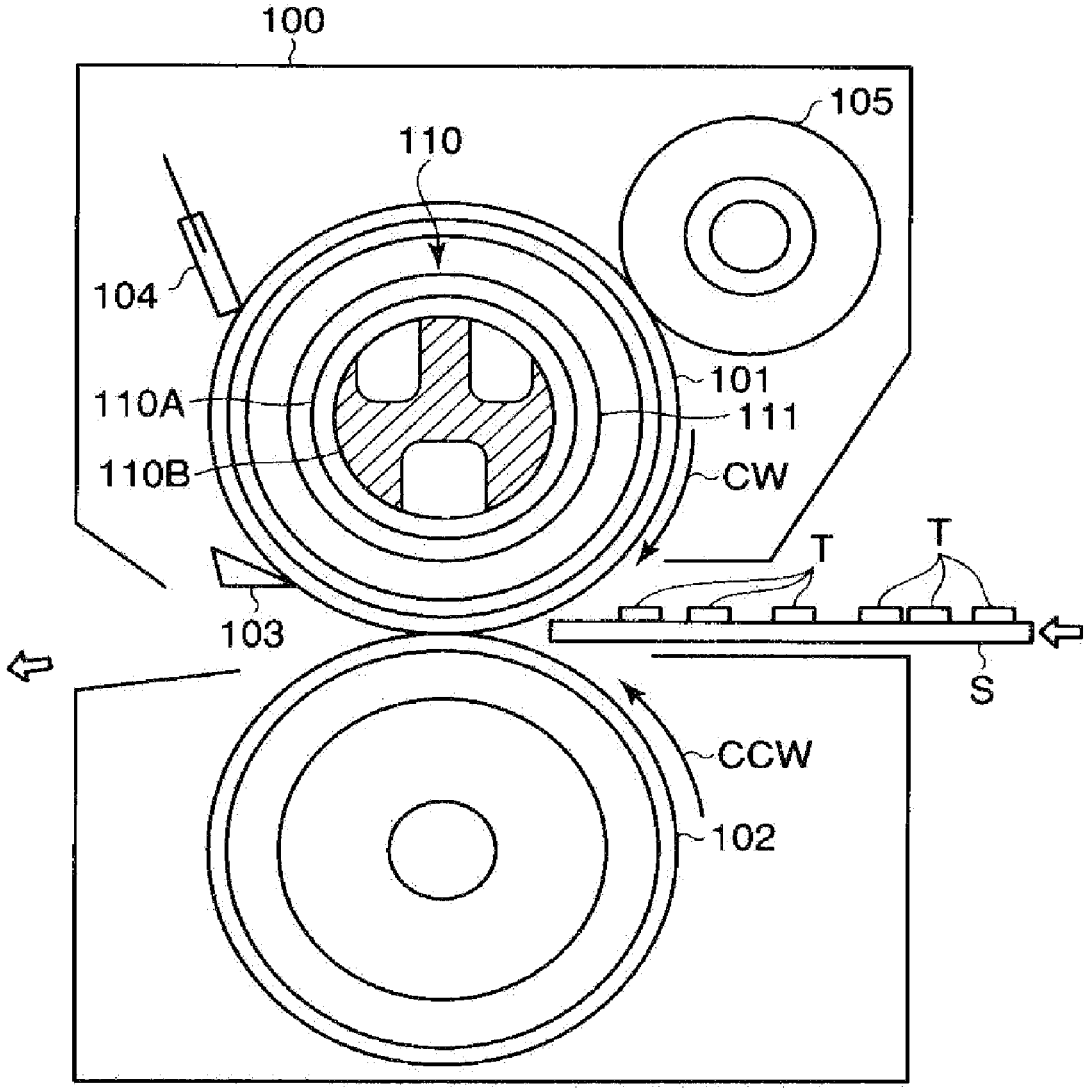
FIG. 2 is a perspective view of a fixing device in accordance with this invention.

Referring now to FIG. 2, there is shown an embodiment of a fixing device 100. The fixing device 100, mentioned later, may fix the toner transferred to the media. A fixing device 100 may contact a surface where the toner has adhered to the media S. The fixing device 100 may comprise a heating roller 101 which heats the toner T and the media S, and a pressurizing roller 102 which gives predetermined pressure to the heating roller 101. A contact portion of the heating roller 101 and the pressurizing roller 102 may have a deformation field, known as nip width.

The heating roller 101 may comprise a roller, formed cylindrically with a conductive material, such as a ferrite, whose periphery may be covered with a fluoro-resin which may comprise a copolymer of polytetra fluoroethylene and perfluoro alkyl vinyl ether, a copolymer of tetra fluoroethylene and hexa fluoroethylene, a copolymer of tetra fluoroethylene and ethylene, a polytetra fluoroethylene, a tetra fluoroethylene, a hexa fluoroethylene, a poly-tetra fluoroethylene, or a copolymer of chloro-tri-fluoroethylene and ethylene. The heating roller 101 may rotate in the arrow direction (in this embodiment, in the clockwise direction) by drive motors, which are not illustrated. The pressurizing roller 102 may rotate in the arrow direction (in this embodiment, in the counter-clockwise direction) by contacting with the heating roller 101.

A developer image T on the media S guided at the contact portion of the heating roller 101 and the pressurizing roller 102 may be fused by heat from the heating roller 101, and may be fixed on the media S by pressure from the pressurizing roller 102. The heating roller 101 may comprise an exfoliation nail 103 for exfoliating the media S from the heating roller 101, a cleaning member 104 for removing a portion of the toner or a waste which may remain on the heating roller 101, and an application roller 105 for applying a release agent to the surface of the heating roller 101.

The heating roller 101 may include a heating unit 110. The heating unit 110 may transfer energy in the form of heat. The heat may be generated by a magnetic inductance source, an infrared, a visual or an ultraviolet light source, an electrical resistance source, a heat exchanger, a chemical reaction source, or otherwise. The heating unit 110 may be disposed within the heating roller 101.

The heating unit 110 may comprise a heating element support 110A. The heating element support 110A may comprise a ceramic material, a composite material, a metal, or otherwise. The choice of what material to manufacture the heating element support 110A may be based on the method of energy transferred by the heating unit 110. For example, if the heating unit 110 transfers energy via infrared light, the heating element support 110A may comprise a ceramic material. Alternatively, if the heating unit 110 transfers energy via inductive resonance, the heating element support 110A may comprise a ferrite bobbin core. The heating element support 110A may be secured to the heating unit 110 by a holding member 110B.

The heating unit 110 may comprise a single heating element or a plurality of heating elements. If the heating unit 110 comprises a plurality of heating elements, it may also comprise a plurality of heating element supports 110A corresponding to the quantity of heating elements 111. The heating element supports 110A may support the heating elements 111. For example, the heating elements 111 may comprise copper coil windings around the heating element supports 110A, for example, ferrite core bobbins. Alternatively, the heating elements 111 may comprise electric resistors which are fused to the heating element supports 110A, for example, a ceramic tube.

Power may be provided to each of the heating elements 111 of the heating unit 110. Power may be provided via an electric power source. Alternatively, power may be provided by a chemical reaction, such as oxidation of ferrite particulate matter. Moreover, power may be provided via a heat exchanger. If the heating elements 111 comprise coils for inductive heating, and high frequency electric power is provided to each heating element 111 of the heating unit 110, a high frequency magnetic field for induction heating may be generated. If a high frequency magnetic field is generated, an eddy current may result in transferring Joule heat energy to the heating roller 101.

Figure 3:
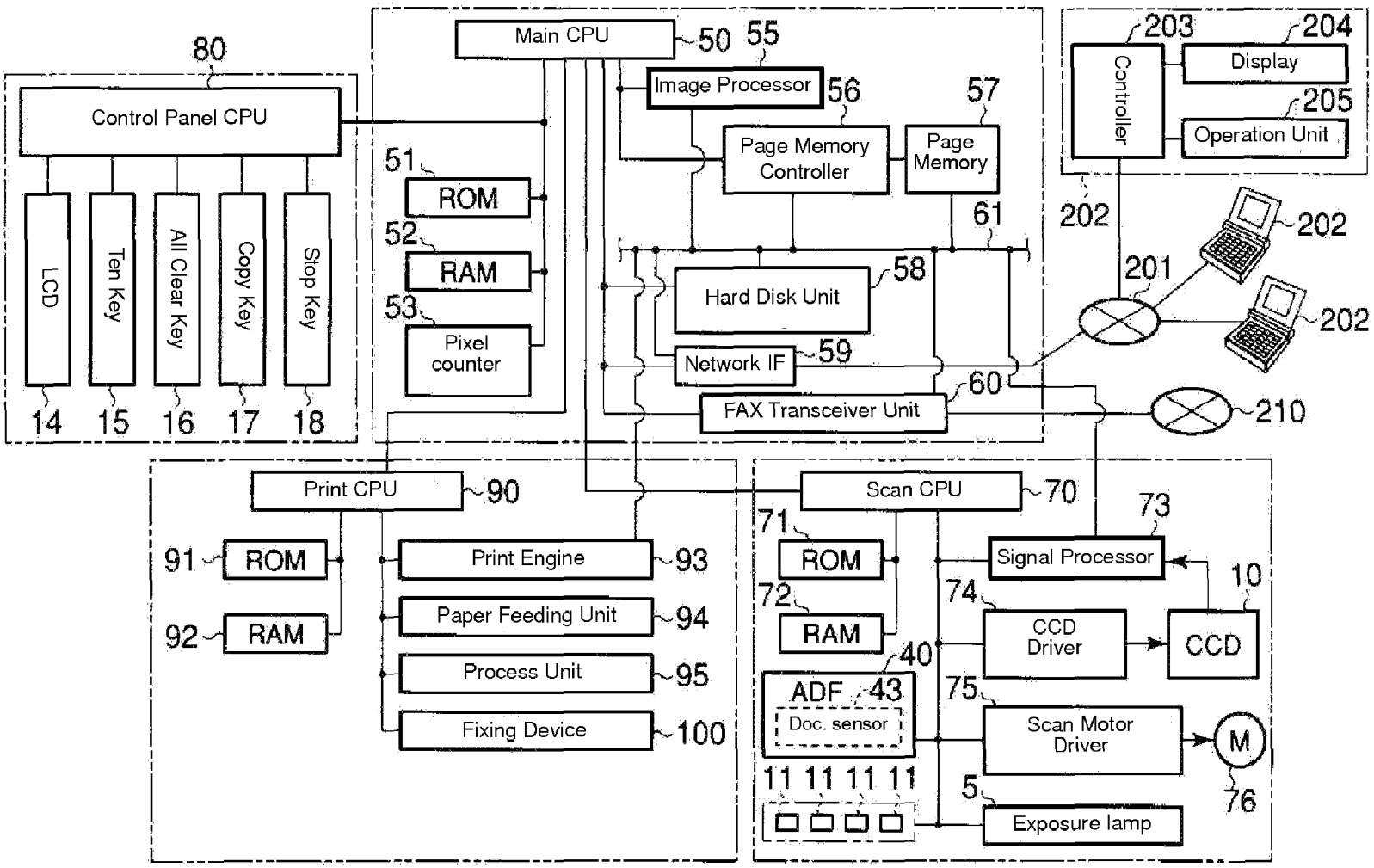
FIG. 3 is a block diagram of a control system of the compound-type electronic copier in accordance with this invention.

Referring now to FIG. 3, there is shown a control circuit block diagram of the compound-type electronic copier. The control circuit may comprise a main CPU 50, connected to a first ROM 51 for control program memory, a first RAM 52 for data memory, a pixel counter 53, the image-processing portion 55, a page memory controller 56, a hard disk unit 58, a network interface 59, and a FAX-transceiver-unit 60. In addition, the main CPU 50 may be connected to a scan CPU 70, a control panel CPU 80, and a print CPU 90.

The main CPU 50 may control the scan CPU 70, the control panel CPU 80, and the print CPU 90. The main CPU 50 may function as a control means during a copy mode responding to an operation of a copy key, a control means during a printer mode responding to an image input to a network interface 59, and a control means during a facsimile mode responding to an image reception by the FAX transceiver unit 60.

The page memory controller 56 may control a writing and a read-out of an image datum to a page memory 57. In addition, the page memory controller 56 may be connected with the image-processing portion 55, the page memory controller 56, a page memory 57, the hard disk unit 58, the network interface 59, and the FAX transceiver unit 60 by an image data bus 61.

The network interface 59 may function as an input portion at the printer mode when the image (image data), transmitted from external equipment, is inputted. A communication network 201, such as a LAN or the Internet, may be connected to the network interface 59, and external equipment, for example, at least one personal computer 202. A personal computer 202 may be equipped with a controller 203, a display 204, and an operation unit 205. The FAX transceiver unit 60 may be connected to a telephone line 210. The FAX transceiver unit 60 may receive an image datum via the telephone line 210.

The scan CPU 70 may be connected to a second ROM 71 for control program memory, a second RAM 72 for data memory, a signal-processing portion 73 that processes and supplies an output of the CCD 10 to the image data bus 61, a CCD driver 74, a scanning motor driver 75, the exposure lamp 5, an automatic document feeder 40, and an original sensor 11. The CCD driver 74 may drive the CCD 10. The scanning motor driver 75 may drive a scanning motor 76 for carriage driving. The automatic document feeder 40 may include the original sensor 43 for detecting if the original D is set to a first tray 41, and the size of the original D.

The control panel CPU 80 may be connected to a touch-sensitive liquid crystal display 14 for a control panel, a ten key 15, an all reset key 16, a copy key 17, and a stop key 18. The print CPU 90 may be connected to a third ROM 91 for control program memory, a third RAM 92 for data memory, a print engine 93, a media feeding unit 94, a process unit 95, and the fixing device 100. The print engine 93 may include the laser unit 27 and its drive circuit. The media-feeding unit 94 may include a media-feeding mechanism applied from a media feed cassette 30 to a second tray 38, and its drive circuit. The process unit 95 may include the photoconductive drum 20 and its circumference. An image-processing portion 55 may process an image. A print portion may print the image to the media P by making the print CPU 90 and its peripheral construction as the subject.

Figure 4:
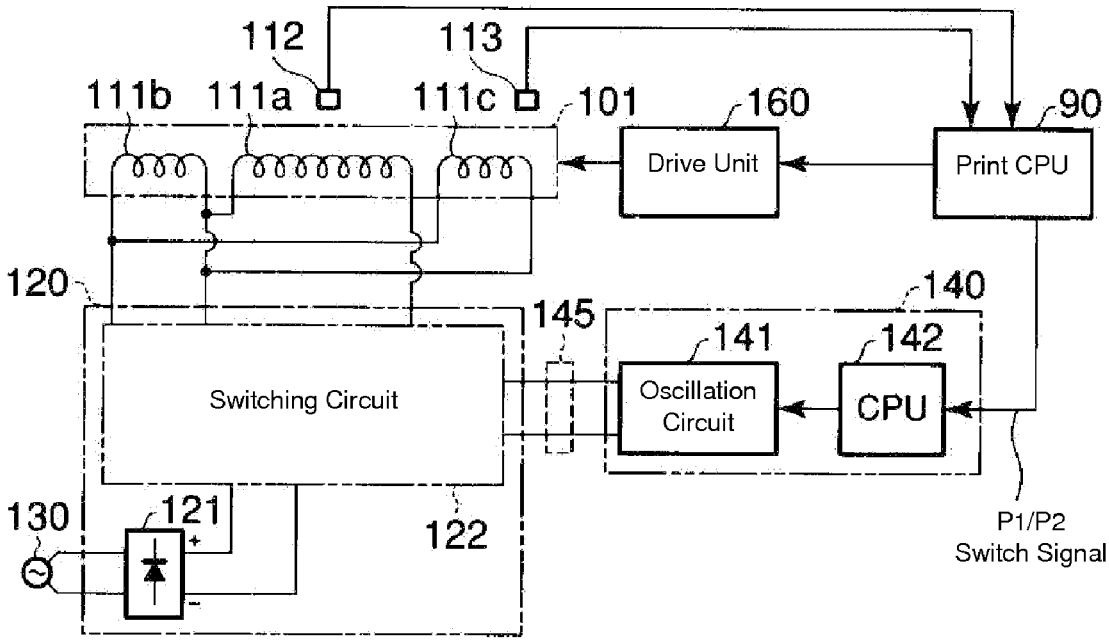
FIG. 4 is a block diagram of a control system of a fixing device in accordance with this invention.

Referring now to FIG. 4, there is shown a block diagram of a control system of the fixing device 100. The embodiment of the heating unit 110 as described in FIG. 4 is a coil unit. In this embodiment, the heating unit 110 is disposed within the heating roller 101. The heating unit 110 of this embodiment may have a plurality of heating elements 111.

Each heating element 111 of this embodiment is an inductive coil. It is not required that heating elements 111 be inductive coils. Alternate embodiments may comprise heat generating resistors, enclosures for chemical reactions, heat exchangers, infrared lights, visual lights, and ultraviolet lights.

The heating element 111 of this embodiment may comprise three coils, 111*a*, 111*b*, and 111*c*. The coil 111*a* may be disposed in the central part of the heating roller 101, and coils 111*b* and 111*c* may be disposed at opposite sides of the coil 111*a* in the heating roller 101, respectively. The coils 111*a*, 111*b*, and 111*c* may be electrically connected to a high frequency generating circuit 120.

A temperature sensor 112 may be disposed in a central part of the heating roller 101. It is not required that the temperature sensor 112 be disposed in the central part of the heating roller 101. The temperature sensor 112 may be disposed close to the central part of the heating roller 101. Alternatively, if the temperature sensor 112 is an infrared type temperature sensor, the temperature sensor 112 may be positioned relative to the heating roller 101 such that the temperature sensor 112 has an unobstructed view of the heating roller 101. The temperature sensor 112 may detect the temperature of the central part of the heating roller 101. The temperature sensor 112 may detect the temperature of coil 111*a*. Alternatively, the temperature sensor 112 may detect the temperature of the heating roller 101 near the coil 111*a*.

The method of determining the temperature of the heating roller 101 near the coil 11*a* is not important. An alternative embodiment may include the temperature of the central part of the heating roller 101 being determined indirectly. For example, the temperature sensor 112 may be disposed exterior to the heating roller 101 and may sense the temperature of the central part of the pressurizing roller 102 (i.e. near the coil 111*a*) at or near the nip width. Alternatively, the temperature sensor 112 may be disposed within the pressure roller and may sense the temperature of the central part of the pressurizing roller 102 at or near the nip width. Since heat may be transferred via conductive heat transfer and/or convective heat transfer from the heating roller 101 to the pressurizing roller 102 at or near the nip width, the temperature of the central part of the pressurizing roller 102 at or near the nip width may have a direct correlation to the temperature of the central part of the heating roller 101. Therefore, the temperature of the central part of the heating roller 101 may be obtained indirectly by performing a heat transfer function on the datum of the temperature of the central part of the pressurizing roller 102 at or near the nip width.

A temperature sensor 113 may be disposed in an end of the heating roller 101. It is not required that the temperature sensor 113 be disposed in an end of the heating roller 101. The temperature sensor 113 may be disposed close to an end of the heating roller 101. Alternatively, if the temperature sensor 113 is an infrared type temperature sensor, the temperature sensor 113 may be positioned relative to the heating roller 101 such that the temperature sensor 113 has an unobstructed view of the heating roller 101. The temperature sensor 113 may detect the temperature of the end portion of the heating roller 101. The temperature sensor 113 may detect the temperature of the coil 111*c*. Alternatively, the temperature sensor 113 may detect the temperature of the heating roller 101 near the coil 111*c*. The temperature sensors 112 and 113 may be electrically connected to the print CPU 90, together with a drive unit 160. The drive unit 160 may be used to rotate the heating roller 101.

The method of determining the temperature of the heating roller 101 near the cloil 111*c* is not important. An alternative embodiment may include the temperature of an end portion of the heating roller 101 being determined indirectly. For example, the temperature sensor 113 may be disposed exterior to the heating roller and may sense the temperature of the end part of the pressurizing roller 102 (i.e. near the coil 111*c*) at or near the nip width. Alternatively, the temperature sensor 113 may be disposed within the pressure roller and may sense the temperature of the end part of the pressurizing roller 102 at or near the nip width. Since heat may be transferred via conductive heat transfer and/or convective heat transfer from the heating roller 101 to the pressurizing roller 102 at or near the nip width, the temperature of the end part of the pressurizing roller 102 at or near the nip width may have a direct correlation to the temperature of the end part of the heating roller 101. Therefore, the temperature of the end part of the heating roller 101 may be obtained indirectly by performing a heat transfer function on the datum of the temperature of the end part of the pressurizing roller 102 at or near the nip width.

The print CPU 90 may control the drive unit 160. The print CPU 90 may also control at least one of power to, current through, frequency to, resonance of, inductance of, voltage across, and temperature at a first heating element 111 and a second heating element 111. If the heating elements 111 provide heat via inductive resonance, the print CPU 90 may generate a P1/P2 switch signal for specifying the operations of a first resonance circuit and a second resonance circuit. The first resonance circuit may comprise a switching circuit 122, a power supply 130 and the coil 111*a*. The second resonance circuit may comprise the switching circuit 122, the power supply 130, and the coil 111*c*. The second resonance circuit may also comprise the coil 111*b*. The print CPU 90 may control the fuser according to the output power of each resonance circuit and the temperature detected by the temperature sensors 112 and 113.

The high frequency generating circuit 120 may generate a high frequency electric power for generating a high frequency magnetic field. The high frequency generating circuit 120 may comprise the switching circuit 122 connected to a rectification circuit 121. The rectification circuit 121 may rectify AC voltage of the commercial AC power supply 130.

The first resonance circuit and second resonance circuit may be excited selectively by a switching element (not shown), such as at least one transistor or FET, disposed inside the switching circuit 122. The first resonance circuit may have a resonance frequency f1 based on the inductance of the coil 111*a*, and electrostatic capacity of a capacitor in the switching circuit 122 (not illustrated). The second resonance circuit may have a resonance frequency f2 based on the inductance of the coils 111*b* and 111*c*, and electrostatic capacity of the capacitor in the switching circuit 122 (not illustrated).

The controller 140 may control the on/off drive of the switching circuit 122 based on a P1/P2 switching signal provided by the print CPU 90. The controller 140 may include an oscillation circuit 141 and a CPU 142. The oscillation circuit 141 may generate a drive signal of a predetermined frequency to the switching circuit 122. The CPU 142 may control an oscillation frequency, and a drive signal frequency of the oscillation circuit 141.

Figure 5:
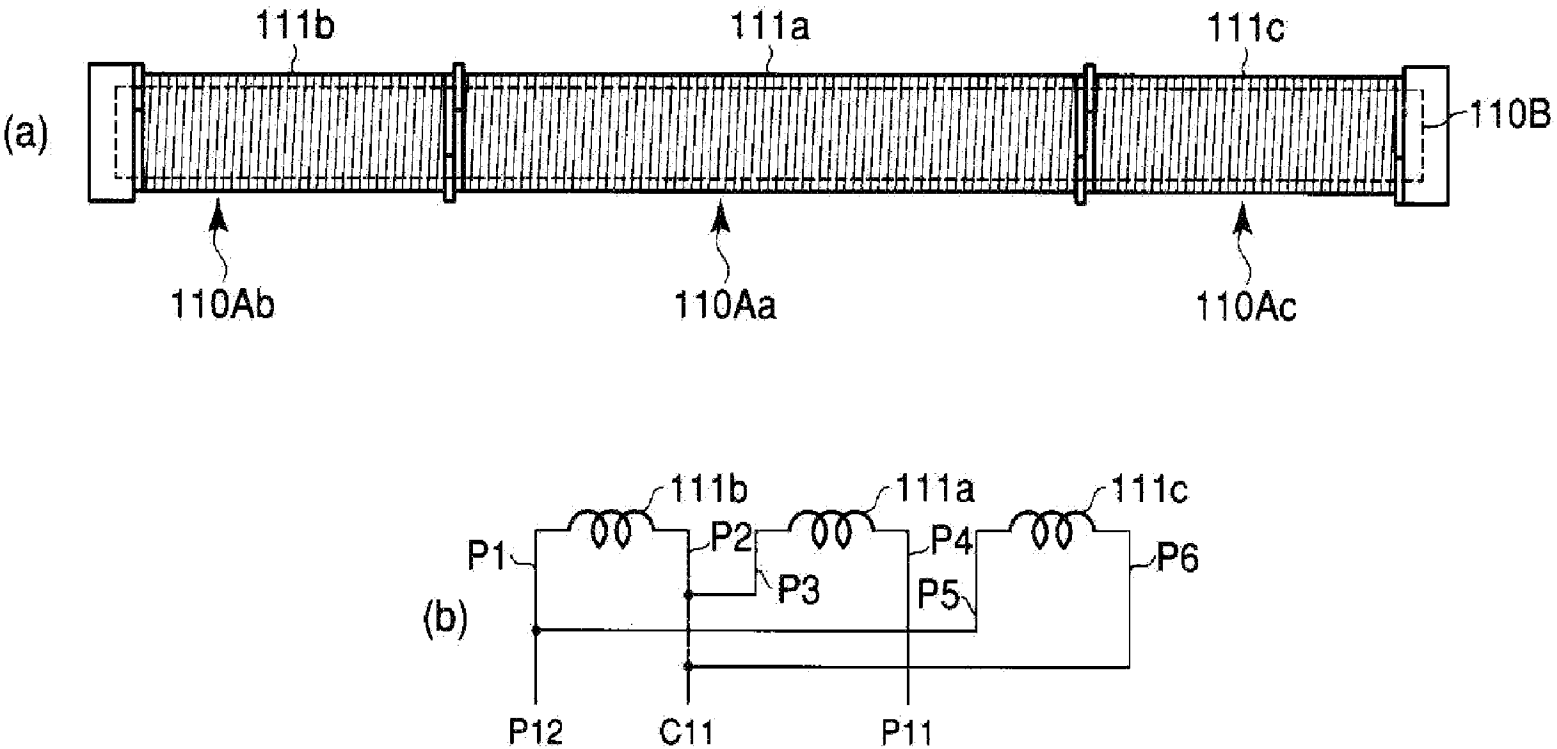
FIG. 5(*a*) is a perspective view of a heating unit embodiment in accordance with this invention.

Referring now to FIG. 5(*a*), there is shown an embodiment of the heating unit 110 comprising the heating elements 111*a*, 111*b*, and 111*c*. The heating elements 111*a*, 111*b*, and 111*c* may comprise electric wire of a predetermined cross-section area that are coiled around the heating element supports 110Aa, 110Ab, and 110Ac, respectively. The heating element support 110Aa may be longitudinally longer than either heating element support 110Ab or 110Ac. The numbers of coil turns of the heating element 111*a* may be greater than the heating elements 111*b* or 111*c*.

Referring now to FIG. 5(*b*), there is shown a circuit diagram of the heating element of FIG. 5(*a*). A first edge P2 of the heating element 111*a*, a first edge P3 of the heating element 111 b and a first edge P6 of the heating element 111*c* may be connected to a junction C11. A second edge P4 of the heating element 111*a* may be connected to a terminal P11. A second edge P1 of the heating element 111*b* and a second edge P5 of the heating element 111*c* may be connected to a junction P12.

The junction C11 may comprise a low voltage common node of an output power P1 and an output power P2. A high voltage node of the output power P1 and the output power P2 may be supplied to the terminals P11 and P12, respectively.

Figure 6:
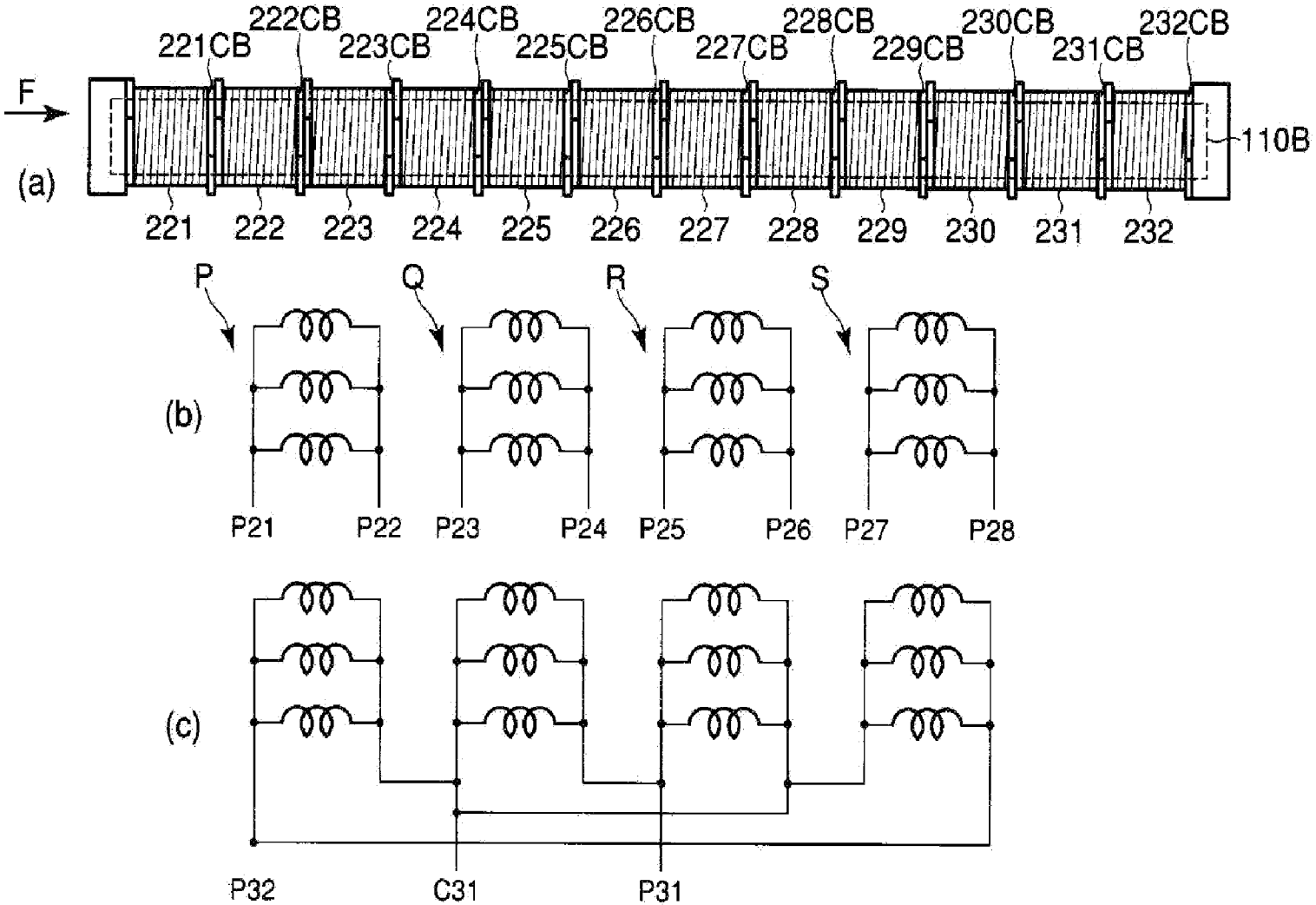
FIG. 6(*a*) is a perspective view of a heating unit embodiment in accordance with this invention.

Referring now to FIG. 6(*a*), there is shown an embodiment of the heating unit 110 with a plurality of inductive heating elements. A coil unit 210 comprises a plurality of coils arranged in the longitudinal direction. The coil unit 210 may include twelve elements, a coil 221-a coil 232, to which a predetermined electric wire may be coiled around a coil bobbin 221CB-a coil bobbin 232CB, respectively. The quantity of elements is not important. For example, an embodiment may include three, five, twenty-seven or more element. The set of coils 221-232 may be held in a predetermined arrangement by a holding member 110B, and may be divided into predetermined coil groups.

Referring now to FIG. 6(*b*), there is shown a circuit diagram of the heating unit 110 of FIG. 6(*a*). The set of coils 221-232 may be divided into four coil groups of three coils connected in parallel. One example of the grouping may be a coil group P comprising the coils 221-223, a coil group Q comprising the coils 224-226, a coil group R comprising the coils 227-229, and a coil group S comprising the coils 230-232. The coil group P may comprise an end P21 and an end P22, the coil group Q may comprise an end P23 and an end P24, the coil group R may comprise an end P25 and an end P26, and the coil group S may comprise an end P27 and an end P28 respectively.

Referring now to FIG. 6(*c*), there is shown a circuit diagram of the heating unit of FIG. 6(*a*). The coil groups Q and R may be electrically connected as the first coil group, and the coil groups P and S may be electrically connected as the second coil group. An electric power of the same magnitude or a different magnitude may be supplied to the first and second coil groups. The electric power supplied to the first and second coil groups may receive the same low voltage common at a junction C31.

Each end P22, P23, P26, and P27 of the coil groups P, Q, R, and S, respectively, may be connected to the junction C31. The ends P24 and P25 of the coil groups Q and R, respectively, which comprise the first coil group, may be connected to the junction C31. The electric power at the high voltage side, which is supplied to the first coil group, may be supplied to the junction C31. Similarly, the ends P21 and P28 of the coil groups P and S, respectively, which comprise the second coil group, may be connected to the junction P32. The electric power at the high voltage side, which may be supplied to the second coil group, may be supplied to the junction P32.

Figure 7:
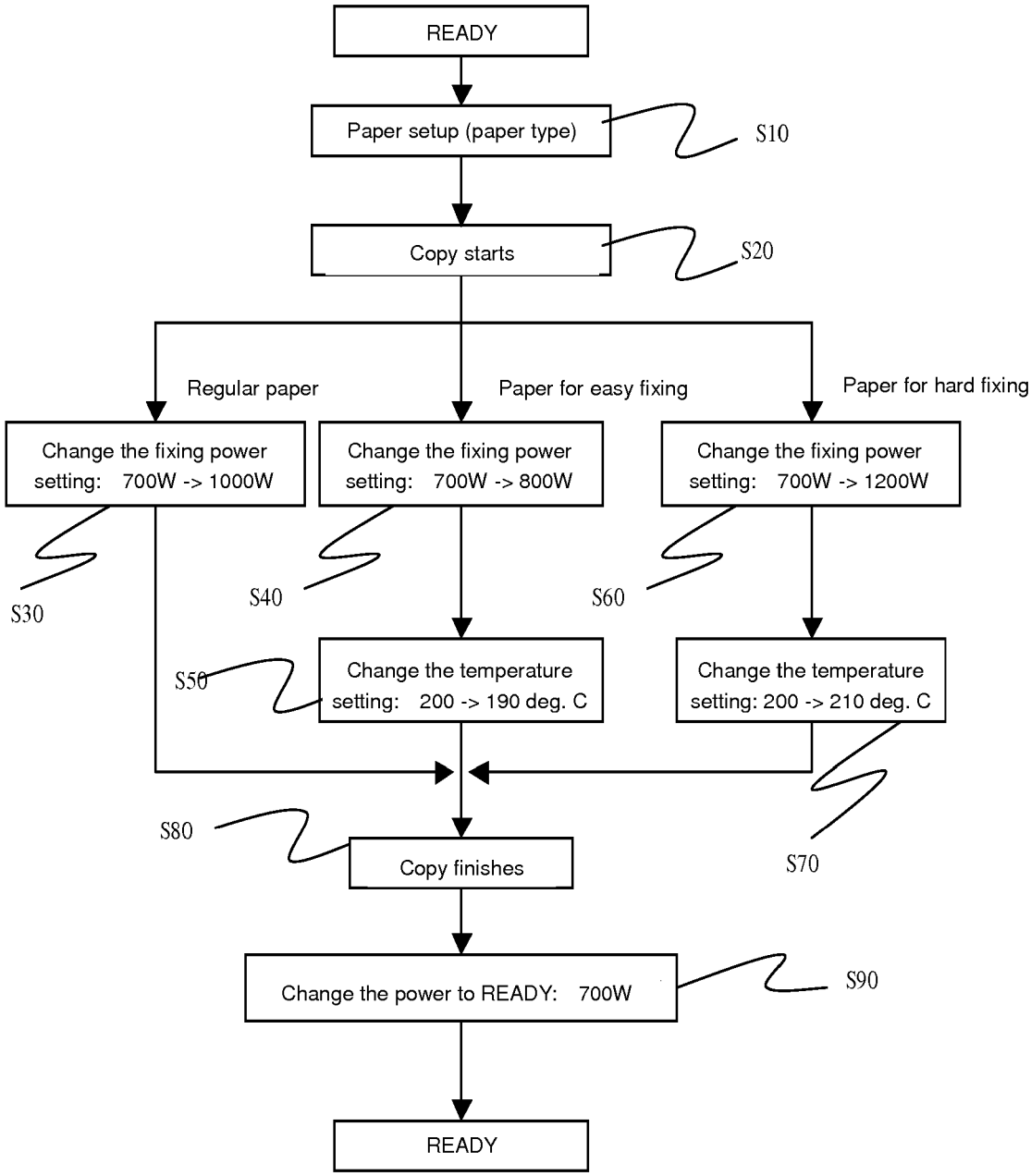
FIG. 7 is a flowchart of a control process embodiment in accordance with this invention.

Referring now to FIG. 7, there is shown a process of changing the electric power setting for the fuser based on the physical characteristics of the media, physical characteristics of the toner and environmental conditions. Various physical characteristics that may be utilized to determine the electric power fuser setting may include one or more of media weight, media thickness, media width, media length, media material composition, media moisture content, media hardness, media gloss, media temperature, chemical and physical characteristics of the toner, air temperature and relative humidity.

At step S10, a media setting may be established via an operation panel. Alternatively, the media itself may have an embedded passive sensor that enables an image forming apparatus to retrieve and utilize the physical characteristics data of the media. Another embodiment may include a physical characteristic analyzer that is integral to the image forming apparatus. Such a physical characteristic analyzer may sense one or more of the media's weight, thickness, width, length, chemical composition, moisture content, hardness, gloss and temperature.

At step S20, a start copy process may be initiated. The start copy process may be initiated by a user input on the operation panel. Alternatively, the copy process may be initiated by a signal over a computer network. Another embodiment may include an automated sensor that detects when a media is inputted to the image forming apparatus.

If the media setting of step S10 is a standard media, at step 30, a fuser power setup may be increased from 700 W to 1000 W. The choice of 700 W and 1000 W are used for example purposes only. The definition of regular media may change over time and therefore a regular media may require an increase from 600 W to 850 W. Alternatively, the increase for a regular media may be from 400 W to 1300 W.

If the toner can be easily fixed on a set-up media, at step S40 the power may be increased from 700 W to 800 W and at step S50 a fixing temperature may be decreased from 200 degrees C. to 190 degrees C. Easily fixed may be defined as requiring only a short amount of time and a reduced amount of energy to fix toner on a set-up media. The actual magnitude of the power is not important. For example, the increase may be from 450 W to 455 W at step S40 and the fixing temperature may be decreased from 180 degrees C. to 178 degrees C. The actual magnitude of the power control and temperature control may depend on the chemical composition and physical characteristics of the toner, the chemical composition and physical characteristics of the media, and environmental conditions such as the composition of the fluid which the media and toner are surrounded by such as fluid temperature and moisture content.

If the toner cannot be easily fixed on the set-up media, at step S60 the power may be increased from 700 W to 1200 W and at step S70 the fixing temperature may be increased from 200 degrees C. to 210 degrees C. A toner not easily fixed on the set-up media may be where more than a reduced amount of energy is required to fix toner on a set-up media. The actual magnitude of the power control is not important. For example, the power may be increased from 600 W to 1150 W at step S70 and the fixing temperature may be increased from 185 degrees C. to 189 degrees C. The actual magnitude of the power control and temperature control may depend on the chemical composition and physical characteristics of the toner, the media and the environment.

At step S80 a copy is performed according to the setup. The setup may be based on the chemical composition and physical characteristics of the toner, the chemical composition and physical characteristics of the media, and environmental conditions such as air temperature and relative humidity. After the main CPU checks that the copy has been completed, the print CPU may change the electric power to READY, and the fixing device may be in standby. Alternatively, the copy controls may be integrated and performed by a single master CPU. Moreover, the copy controls may be distributed and performed over a shared network of processors, located locally and/or remotely.

Figure 8:
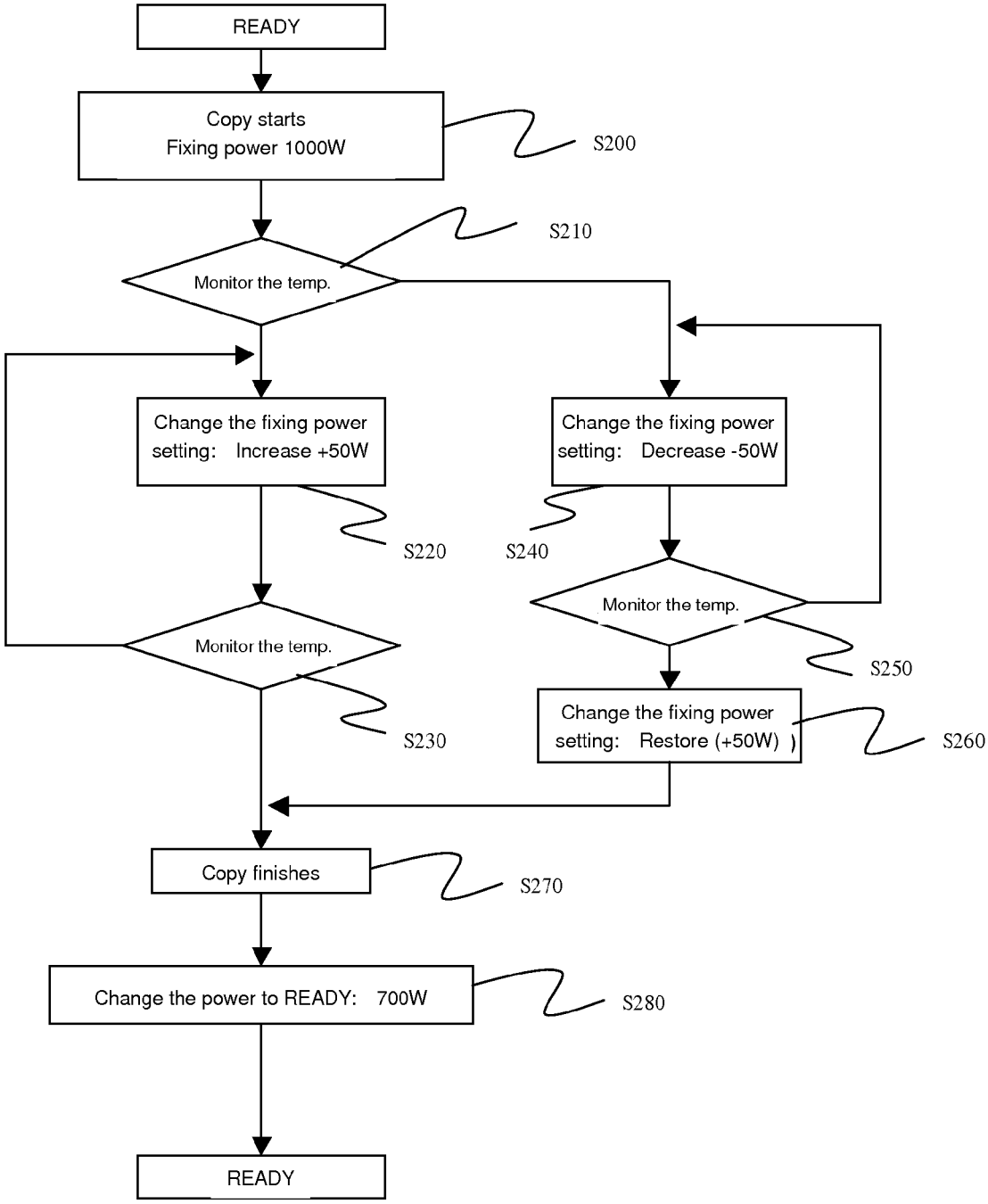
FIG. 8 is a flowchart of a control process embodiment in accordance with this invention.

Referring now to FIG. 8, there is shown a process of controlling the fixing electric power based on monitoring the fixing temperature. It is not required that control of the fixing electric power be based on the fixing temperature. Alternatively, the control process of fixing electric power may include monitoring the toner temperature at the nip width. An alternative process of monitoring the fixing temperature may include utilizing a sensor which monitors thermal expansion of the heating unit 110. A person skilled in the art would know of methods to utilize the physical expansion of the heating unit 110 and the coefficient of thermal expansion of the material of the heating unit 110 to calculate the temperature of the heating unit 110. Alternatively, a sensor may monitor the thermal expansion of the heating roller 101 or the pressurizing roller 102. A sensor to monitor the thermal expansion may be laser based, infrared based or ultraviolet based. Alternatively, linear transducers may be utilized to monitor thermal expansion.

Another embodiment to indirectly calculate the temperature of the heating unit 110 may include submerging at least one of the heating unit 110, the heating roller 101, and the pressurizing unit 102 in a fluid which resides in a non-sealed vessel. The fluid utilized may be water, glycol, air, nitrogen, or any other suitable fluid. The choice of fluid is not important. The choice of fluid may be based on the fluid's physical properties such as coefficient of thermal expansion, density and conductivity. As the temperature of the heating unit 110, heating roller 101 or pressurizing unit changes, the volume of the heating unit 110, heating roller 101 or pressurizing unit will proportionally change resulting in the fluid level rising or dropping. A person skilled in the art would be able to calculate the temperature based on the change in volume.

Alternatively, the fluid may reside in a sealed vessel. As the temperature of the heating unit 110, heating roller 101, or pressurizing unit 102 changes, a proportional change in pressure of the fluid may result. One skilled in the art would be able to correlate the pressure in the fluid to the temperature of the heating unit 110, heating roller 101 or pressurizing unit 102.

If a copy is commenced, the fixing device may start operation at a set-up fixing power of 1000 W (Step S200). The set-up fixing power is not important. Alternate set-up fixing powers may include 800 W, 850 W, 100 W, or 900 W. The choice of the set-up fixing power may depend on the physical characteristics of the media, the toner, and the environmental conditions.

A controller may monitor the fixing temperature (Step S210). The controller may monitor the fixing temperature directly via sensors or indirectly. If the fixing temperature decreases while being monitored, the controller may cause a fuser electric power to be increased by 50 W so that the decrease of the fixing temperature stops (Step S220). The magnitude of the power increase is not limited to 50 W. Depending on the characteristics of the system, the fuser electric power may be increased by 0.5 W, 5 W, or 35 W.

If the temperature of the fuser continues to fall, the controller may cause the fuser electric power to be increased by an additional 50 W (Step S230). The magnitude of the power increase is not limited to 50 W. Depending on the characteristics of the system, the fuser electric power may be increased by 0.5 W, 5 W, or 35 W.

If the fixing temperature is stable at Step S210, the controller may cause the fuser power setup to be reduced by 50 W (Step S240). The magnitude of the power decrease is not limited to 50 W. Depending on the characteristics of the system, the fuser electric power may be decreased by 0.5 W, 5 W, or 35 W.

If the fuser temperature remains stable at Step 250, the controller may cause the fuser power setup to be decreased by an additional 50 W. The magnitude of the power decrease is not limited to 50 W. Depending on the characteristics of the system, the fuser electric power may be decreased by 0.5 W, 5 W, or 35 W.

If it is detected that the temperature of the fuser has decreased at Step S250, the controller may cause the power supplied to the fuser to be increased by 50 W. The magnitude of the power increase is not limited to 50 W. Depending on the characteristics of the system, the fuser electric power may be increased by 0.5 W, 5 W, or 35 W.

If the copy finishes (Step S270), the controller may cause a reduction in electric power being provided to the fuser to 700 W at READY mode. The READY mode power is not important. Alternate READY mode powers may include 600 W, 650 W, 100 W, or 900 W. The choice of the READY mode power may depend on the physical characteristics of the media, the toner, and the environmental conditions.

According to the fixing device by this invention, electric power of a fuser may be controlled based on first temperature sensor associated with the first heating element, a humidity sensor, a second temperature sensor associated with the second heating element, a media thickness sensor, a media moisture content sensor, a media temperature sensor, and a developer temperature sensor.

Since setup of the fixing temperature may be changed while the power consumption is modified, fixing may be performed with appropriate conditions, which suits each type.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

It is claimed:

1. A developer fuser comprising:

a first heating element for transferring energy for fusing a developer to a media during a copy process a second heating element a controller for controlling a first electrical power provided to the first heating element and a second electrical power provided to the second heating element, wherein the controller is adapted to set the first electrical power to a predetermined first ready power level before initiation of the copy process set the first electrical power to a first set-up power level upon initiation of the copy process, the first set-up power level determined, at least in part, by a physical characteristic of the media vary the first electrical power in response to an input from a first temperature sensor to maintain a fixing temperature during the copy process, the fixing temperature determined, at least in part, by the physical characteristic of the media set the first electrical power to the predetermined first ready power level upon completion of the copy process set the second electrical power to a predetermined second ready power level prior to initiation of the copy process set the second electrical power to a second set-up power level upon initiation of the copy process, the second set-up power level determined, at least in part, by a physical characteristic of the media vary the second electrical power in response to an input from a second temperature sensor to maintain the fixing temperature during the copy process set the second electrical power to the second ready power level upon completion of the copy process.

2. The developer fuser of claim 1, wherein the first set-up power level and the fixing temperature are determined, at least in part, by a physical characteristic of the toner and an environmental condition.

3. The developer fuser of claim 1, wherein the physical characteristic of the media includes at least one of the group consisting of media weight, thickness, width, chemical composition, moisture content, hardness, and gloss.

4. The developer fuser of claim 1, wherein the physical characteristic of the media is provided to the controller by one of the group comprising a media setting on a control panel, a passive sensor detecting information embedded in the media, and a media physical characteristics analyzer.

5. The developer fuser of claim 1, wherein the first electrical power is controlled by controlling at least one of the current through, frequency to, resonance of, inductance of, and voltage across the first heating element.

6. An image forming apparatus comprising the developer fuser of claim 1.

7. A copy machine comprising the developer fuser of claim 1.

8. A controller for a developer fuser for fusing a developer to a media, the controller adapted to:

receive a first temperature sensor datum, and a second temperature sensor datum, control a first electrical power provided to a first heating element based on the first temperature sensor datum and a physical characteristic of the media control a second electrical power provided to a second heating element based on the second temperature sensor datum and a physical characteristic of the media wherein the controller is further adapted to set the first electrical power and the second electrical power to predetermined first and second ready power levels respectively before initiation of the copy process set the first electrical power and the second electrical power to first and second set-up power levels respectively upon initiation of the copy process, the first and second set-up power levels determined, at least in part, by the physical characteristic of the media vary the first and second electrical power levels in response to the first temperature sensor datum and the second temperature sensor datum respectively to maintain a fixing temperature during the copy process, the fixing temperature determined, at least in part, by the physical characteristic of the media set the first electrical power and the second electrical power to the predetermined first and second ready power levels respectively upon completion of the copy process.

9. The controller for a developer fuser of claim 8, wherein the first electrical power and the second electrical power are set according to a physical characteristic of the media, a physical characteristic of a toner to be applied to the media, and an environmental condition.

10. The controller for a developer fuser of claim 8, wherein the controller is further adapted to receive at least one of a humidity datum, a media thickness datum, a media moisture content datum, a media temperature datum, and a developer temperature datum, and control the first electrical power and the second electrical power based on at least one of the humidity datum, the media thickness datum, the media moisture content datum, the media temperature datum, and the developer temperature datum.

11. An image forming apparatus comprising the controller for the developer fuser of claim 8.

12. A copy machine comprising the controller for the developer fuser of claim 8.

13. A process for reducing power consumption in a developer fuser for fusing a developer to a media, the process comprising:

prior to initiation of the copy process a control system setting a first electrical power provided to a first heating element to a predetermined first ready power level the control system setting a second electrical power provided to a second heating element to a predetermined second ready power level upon initiation of a copy process the control system setting the first electrical power to a first set-up power level, the first set-up power level based on, at least in part, a physical characteristic of the media the control system setting the second electrical power to a second set-up power level, the second set-up power level based on, at least in part, a physical characteristic of the media during the copy process the control system varying the first electrical power in response to an input from a first temperature sensor to maintain a fixing temperature, the fixing temperature based on, at least in part, the physical characteristic of the media the control system varying the second electrical power in response to an input from a second temperature sensor to maintain the fixing temperature after completion of the copy process the control system setting the first electrical power to the predetermined first ready power level the control system setting the second electrical power to the predetermined second ready power level.

14. The process for reducing power consumption in a developer fuser of claim 13, wherein the physical characteristic of the media includes at least one of the group consisting of media weight, thickness, width, chemical composition, moisture content, hardness, and gloss.

15. The process for reducing power consumption in a developer fuser of claim 13, wherein the physical characteristic of the media is provided to the controller by one of the group comprising a media setting on a control panel, a passive sensor detecting information embedded in the media, and a media physical characteristics analyzer.

16. The process for reducing power consumption in a developer fuser of claim 13, wherein the first electrical power is set by controlling at least one of the current through, frequency to, resonance of, inductance of, and voltage across the first heating element.

17. The process for reducing power consumption in a developer fuser of claim 13, wherein the first set-up power level and the fixing temperature are set, at least in part, according to a physical characteristic of the media, a physical characteristic of a toner to be applied to the media, and an environmental condition.

18. The process for reducing power consumption in a developer fuser of claim 14, wherein the first set-up power level and the fixing temperature are set, at least in part, based on a datum from a sensor selected from the group consisting of a humidity sensor, a media thickness sensor, a media moisture content sensor, a media temperature sensor, and a developer temperature sensor.

* * * * *